US007850483B2

(12) United States Patent
Siglock et al.

(10) Patent No.: US 7,850,483 B2
(45) Date of Patent: Dec. 14, 2010

(54) POWER METER SOCKET TO CIRCUIT BREAKER CONNECTION

(75) Inventors: John V. Siglock, Kansas City, MO (US); Shawn J. Glasgow, Kansas City, MO (US)

(73) Assignee: Milbank Manufacturing Co., Kansas City, MO (US)

( * ) Notice: Subject to any disclaimer, the term of this patent is extended or adjusted under 35 U.S.C. 154(b) by 100 days.

(21) Appl. No.: 12/193,424

(22) Filed: Aug. 18, 2008

(65) Prior Publication Data

US 2009/0059480 A1 Mar. 5, 2009

Related U.S. Application Data

(60) Provisional application No. 60/965,412, filed on Aug. 20, 2007.

(51) Int. Cl.
*H01R 33/945* (2006.01)

(52) U.S. Cl. ..... 439/517

(58) Field of Classification Search ..... 439/517
See application file for complete search history.

(56) References Cited

U.S. PATENT DOCUMENTS 5,289,148 A * 2/1994 Siglock et al. ..... 335/202
7,503,800 B2 * 3/2009 Siglock et al. ..... 439/517

* cited by examiner

*Primary Examiner*—Javaid Nasri
(74) *Attorney, Agent, or Firm*—Polsinelli Shughart PC

(57) ABSTRACT

A one-piece power meter socket to circuit breaker connection structure includes an elongated trunk section connecting a lower spade section with a forwardly offset connection plate at an upper end. The connection plate is joined to the trunk section by an angled extension section. The connection plate has an aperture to receive a fastener to connect it and a meter jaw to a meter jaw base. The spade section includes a pair of laterally spaced, forwardly projection breaker receiving spades for reception in a receptacle of a circuit beaker. The connection structures are used in pairs with an insulating circuit breaker base to connect load-side meter jaws of a power meter socket to spade receptacles of a plug-in type of circuit breaker. The one-piece connection structure is formed of a sheet of metal having a thickness equal to the thickness specified for the spades engaged by the circuit breaker.

18 Claims, 5 Drawing Sheets

POWER METER SOCKET TO CIRCUIT BREAKER CONNECTION

CROSS-REFERENCE TO RELATED APPLICATION

This application claims priority under 35 U.S.C. 119(e) and 37 C.F.R. 1.78(a)(4) based upon U.S. Provisional Application Ser. No. 60/965,412 for NEW INTERCONNECTION METHOD BETWEEN WATT-HOUR METER SOCKET BASE AND PLUG-IN CIRCUIT BREAKER, filed Aug. 20, 2007, which is incorporated herein by reference.

BACKGROUND OF THE INVENTION

The present invention relates generally to a connection structure between a watt-hour meter socket base and one or more plug-in type circuit breakers, also referred to as plug-on circuit breakers. It is known to those in the trade that the connection path must consist of an electrically conductive material. Very often insulated copper or aluminum cables are employed, requiring the use of tested and approved electrical wire connectors. These connectors require mounting fasteners, typically a bolt, spring washer, and nut. Additionally, the cable requires preparation. Namely the insulation must be carefully removed so as not to reduce the conductor cross section, and the wire must be shaped or formed so that its ends are cooperatively received by the aforementioned wire connectors.

Another known connection structure commonly employs the use of bus bars such as copper or aluminum with rectangular cross sections. As an example, a 200 A (ampere) circuit breaker connection using copper bus bar may have a cross section of 0.188 inch by 1.000 inch (0.48 cm by 2.54 cm) or an aluminum bus bar with a cross section of 0.250 inch by 1.000 inch (0.64 cm by 2.54 cm). This method requires various manufacturing operations, typically, cut to length, drilled or punched holes, and forming. Due to the rigidity of the bus bar, the forming must be very accurate to ensure alignment of the meter socket base and circuit breaker base. Furthermore, for a bus bar, an element must be added to receive the circuit breaker. The circuit breaker is typically mounted to a receiving spades or lugs 0.093 inch (2.36 mm) thick, thus requiring the use of an additional part and fasteners. Additionally, regulatory agencies require tin or silver plating be applied on areas where connections are made.

FIG. 1 shows a typical modern 200 ampere meter socket base assembly 200 connected by formed bus connectors 202 to a circuit breaker receiving assembly 204. The illustrated meter socket base assembly 200 is connected to copper bus bars 202, while opposite ends of the bus bars are connected to the circuit breaker receiving assembly 204. Load side meter socket jaws 206 are secured to the bus bars 202 and insulating bases 208 that provide the proper mounting height along with meter blade guides 210. The bus bars 202 are additionally secured to circuit breaker contact elements 211 by fasteners such as screws and corresponding nuts. The circuit breaker contact elements 211, including circuit breaker receiving blades 212, are secured to a breaker insulating base 215 by fasteners such as push-nuts 218. Note that the illustrated assembly 200 is comprised of 24 unique parts and a total of 49 parts.

FIG. 2 shows a typical modern 200 ampere meter socket base assembly 230 connected by formed wires 232 to a circuit breaker receiving assembly 234. The assembly 230 is similar to the assembly 200. The illustrated meter socket base assembly 230 is connected to the wires 232, while opposite ends of the wires are connected to the circuit breaker receiving assembly 234. Load side meter socket jaws 236 are secured by suitable fasteners to wire connectors 238 and insulating bases 240 that provide the proper mounting height. The wires 232 are secured to the wire connectors 238 with nuts and set screws 242. Opposite ends of the wires 232 are secured to circuit breaker contact elements 243, including spaced apart circuit breaker receiving spades 244, by connectors and set screw units 246. The circuit breaker contact elements 243 are secured to a circuit breaker insulating base 248 by fasteners such as push-nuts 250. Note that this construction is comprised of 24 unique parts and a total of 60 parts.

The prior art construction described above has disadvantages. First, the use of additional components acts to increase both material and labor costs. Second, the additional connections contribute to the heating of the device.

SUMMARY OF THE INVENTION

The present invention provides a power meter socket to circuit breaker connection structure for connecting load-side watt-hour meter socket terminals to a plug-in or plug-on type of circuit breaker unit. An embodiment of the connection structure generally includes an elongated, generally Z-shaped conductor member having a connection plate at a top end, an angled extension section, an elongated trunk section, and a spade section. The connection plate is planar and has a fastener receiving aperture formed through it. The connection plate may include additional features for controlling the orientation of the connector plate with respect to a socket terminal jaw. The extension and trunk sections may be formed by a central web with backwardly extending flanges for stiffening purposes. The extension section is oriented at an angle which positions the connection plate forward of the web of the trunk section. The trunk section may have an aperture formed therethrough for securing the connection structure to an insulating circuit breaker base. The spade section is positioned at a lower end of the trunk section and has a pair of laterally spaced circuit breaker receptacle receiving spades extending forward of a web of the spade section.

For a two conductor AC service, an identical pair of the connection structures are secured to the circuit breaker base in laterally spaced, parallel relation. The circuit breaker base may have slide-in retainers which engage the apertures through the trunk section and a lower edge of the spade section web. The connection plates of the structures are fastened to a pair of laterally spaced load-side meter socket jaws which receive a pair of load-side spades of a conventional type of watt-hour meter. The circuit breaker base positions the connection structures such that an adjacent pair of the two connection structures are properly spaced to receive the spaced apart receptacles of a standard type of plug-in circuit breaker.

Each of the connection structures is formed of a single blank of sheet metal having a uniform thickness. The selected thickness is the same thickness specified for spades to receive the spade receptacles of the circuit breakers, typically 0.093 inch (2.36 mm) thick. The metal employed combines high conductivity with high strength and good economy, such as aluminum, copper, or alloys thereof.

The present invention reduces the number of components required to manufacture meter sockets with provision for plug-in circuit breakers of 125 to 225 ampere ratings. One embodiment of the invention reduces part count of the connection between the meter socket base assembly to the plug-in circuit breaker by 11 unique parts and 17 total parts for the bus version or 11 unique parts and 28 total parts for the wired version. This embodiment of the invention is comprised of 3 total parts and 2 unique parts. Assembly costs are in direct proportion to the number of components used.

The present invention also reduces the number of manufacturing operations required to manufacture meter sockets with provision for plug-in circuit breakers of 125 to 225 ampere ratings. The conventional bus bars 202 (FIG. 1) are typically manufactured with multiple manufacturing operations. The bus bars 202 are first sheared to length, features added to each end to facilitate connection to the other components, and then formed to the proper shape. The wires 232 (FIG. 2) are typically first cut to length, the ends carefully stripped to expose the correct amount of conductor, and then formed to the proper shape. The invention is die-run complete in a single progressive stamping operation.

The present invention reduces the material cost required to manufacture meter sockets with provision for plug-in circuit breakers of 125 to 225 ampere ratings. The implementations illustrated in FIGS. 1 and 2 employ a circuit breaker receiving element insulating mounting base of approximately the same cost. The remaining 16 components required for the implementation of the bus version illustrated in FIG. 1 for a 200 A rated assembly have a current market value (2008) of approximately $4.72. The remaining 27 components required for the implementation of the wired version illustrated in FIG. 2 for a 200 A rated assembly have a current market value of approximately $6.80. The two remaining parts of the invention have a current market value of approximately $1.21.

Various objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
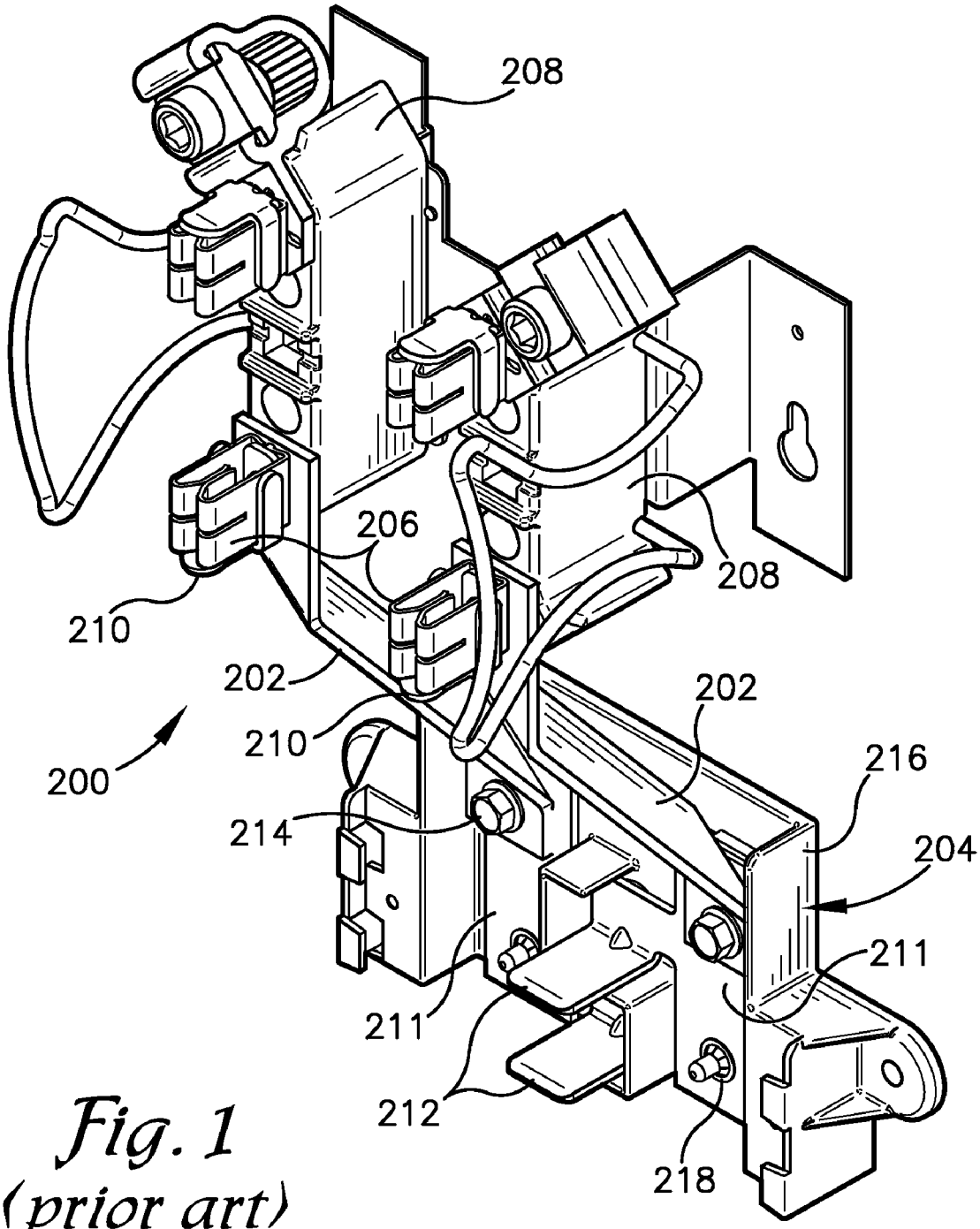
Fig. 1 (prior art)
FIG. 1 is a perspective view of a prior art watt-hour meter socket and circuit breaker mounting structure employing formed bus bars.
Figure 2:
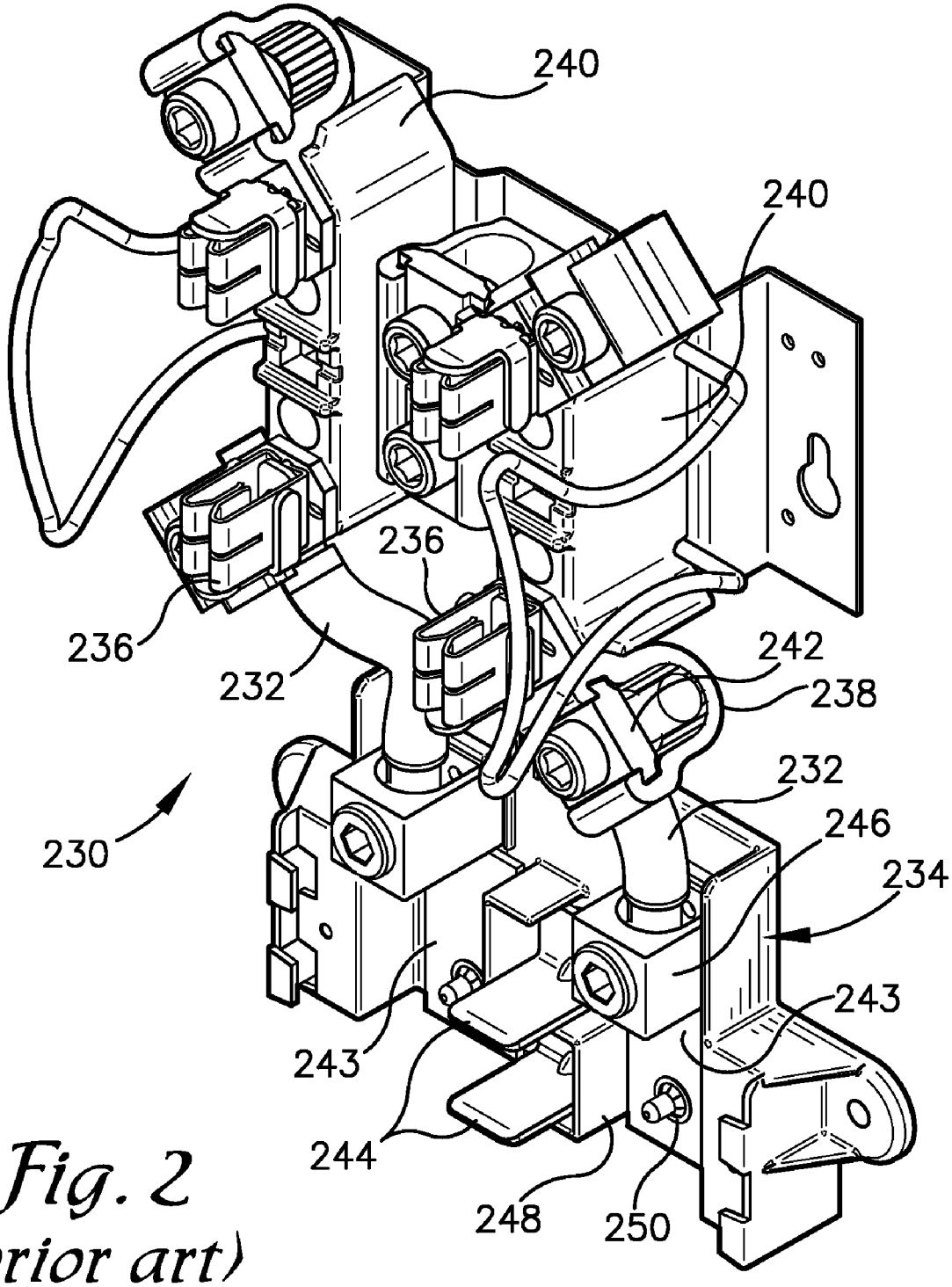
Fig. 2 (prior art)
FIG. 2 is a perspective view of a prior art watt-hour meter socket and circuit breaker mounting structure employing shaped bus wires.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 (FIGS. 3-5) generally designates an embodiment of a power meter socket to circuit breaker connection structure according to the present invention. The structure 1 generally provides a one-piece connection between a load-side meter socket jaw 2 of a meter socket assembly 3 and a circuit breaker receiving assembly 4. For a typical two-wire installation, a pair of the connection structures 1 are employed.

Figure 3:
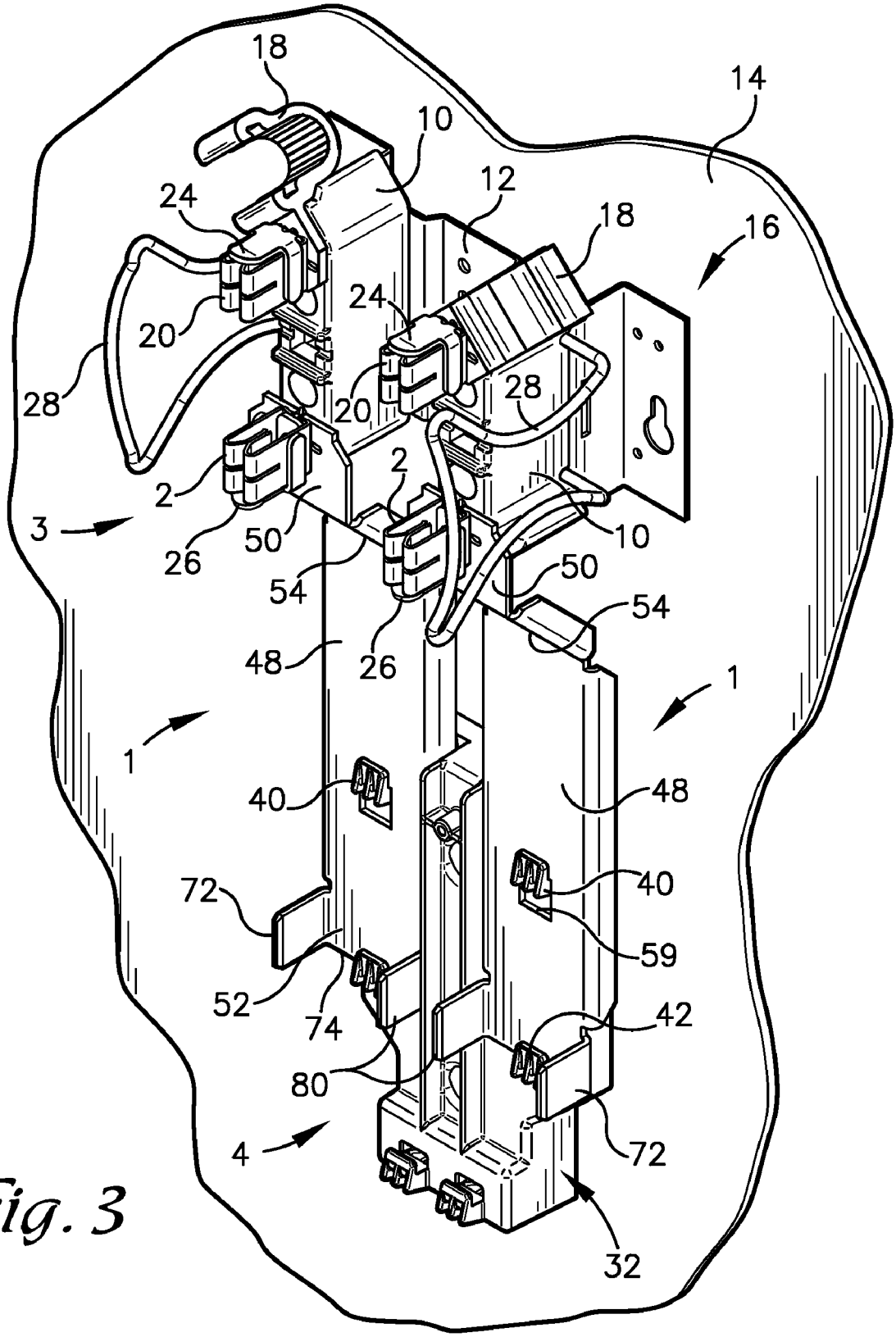
FIG. 3 is a perspective view of a watt-hour meter socket and circuit breaker assembly incorporating an embodiment of a power meter to circuit breaker connection structure according to the present invention.
Figure 4:
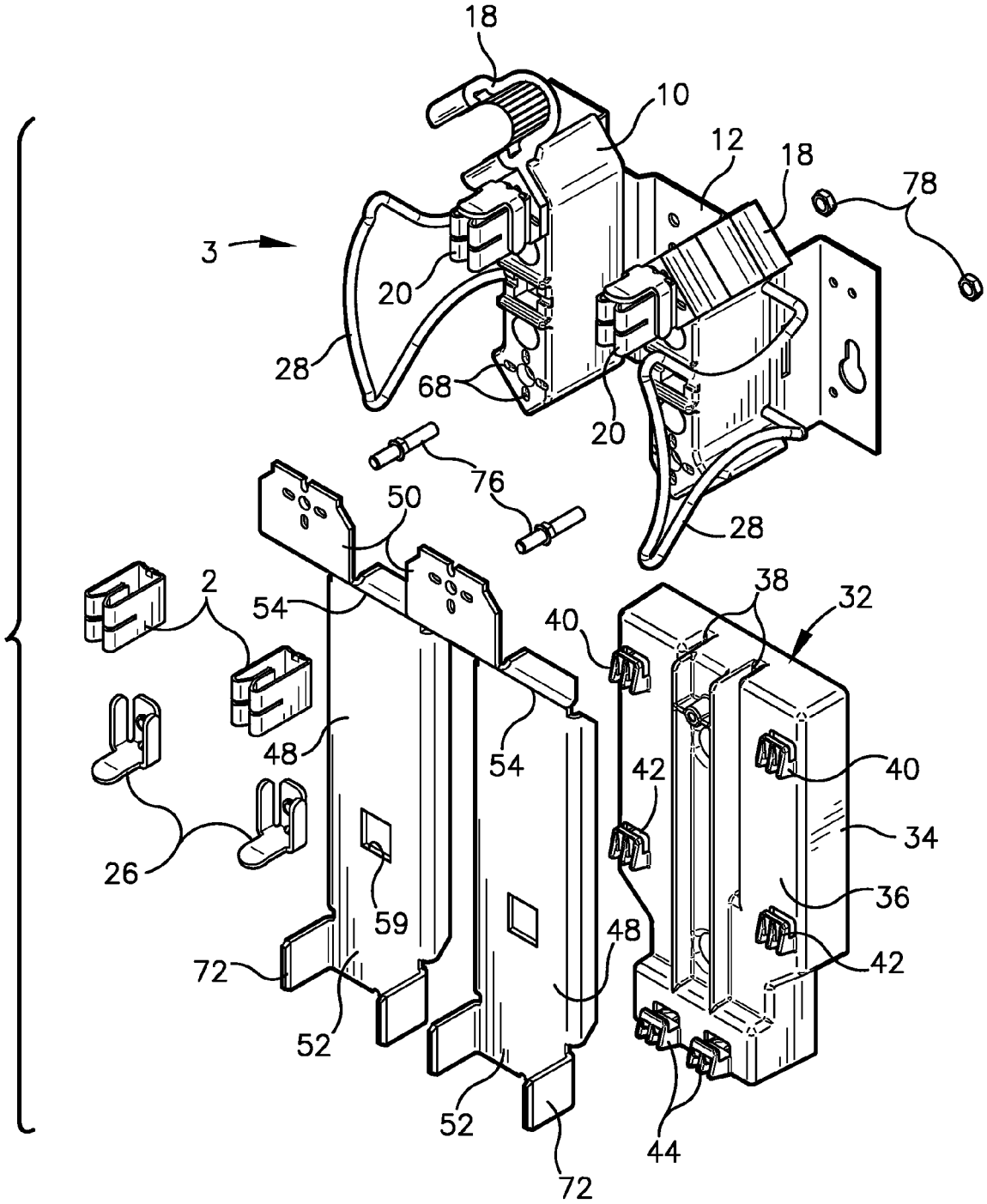
FIG. 4 is an exploded perspective view of the power meter to circuit breaker connection structure embodiment shown in FIG. 3.

Referring to FIGS. 3 and 4, the meter socket assembly 3 generally includes a pair of insulating meter socket bases 10 fastened to a meter socket riser 12, which is then fastened to a rear wall 14 of a meter socket enclosure 16. The bases 10 have respective supply wire connectors 18, supply-side meter socket jaws 20, and the load-side meter socket jaws 2. The supply-side jaws 20 may include meter spade guides 24, while the load-side jaws 2 include guides 26. The assembly 3 may include left and right arcuate wire meter supports 28 which engage a ring on the watt-hour meter (not shown). The meter socket assembly 3, thus described, is a conventional type of socket assembly for receiving a conventional type of watt-hour meter which bridges between the left and right hand sets of a supply-side meter jaw 20 and a load-side jaw 2.

The illustrated circuit breaker receiving assembly 4 includes an insulating circuit breaker assembly base 32 which is fastened or otherwise secured to the enclosure wall 14 in a position below the meter socket assembly 3. The base 32 positions a plug-in circuit breaker and conductors connected thereto at a required distance from the enclosure wall 14. The illustrated circuit breaker base 32 includes a molded body 34 having a front surface 36 (FIG. 4) with a pair of parallel, vertical slots 38 formed therein. Upper and lower pairs of laterally spaced slide-in retainers 40 and 42 are formed on the front surface 36 of the base 32. The base 32 may also have additional retainers 44 formed at a lower end thereof for supporting other articles, such as a lower end of a circuit-breaker unit (not shown).

Figure 5:
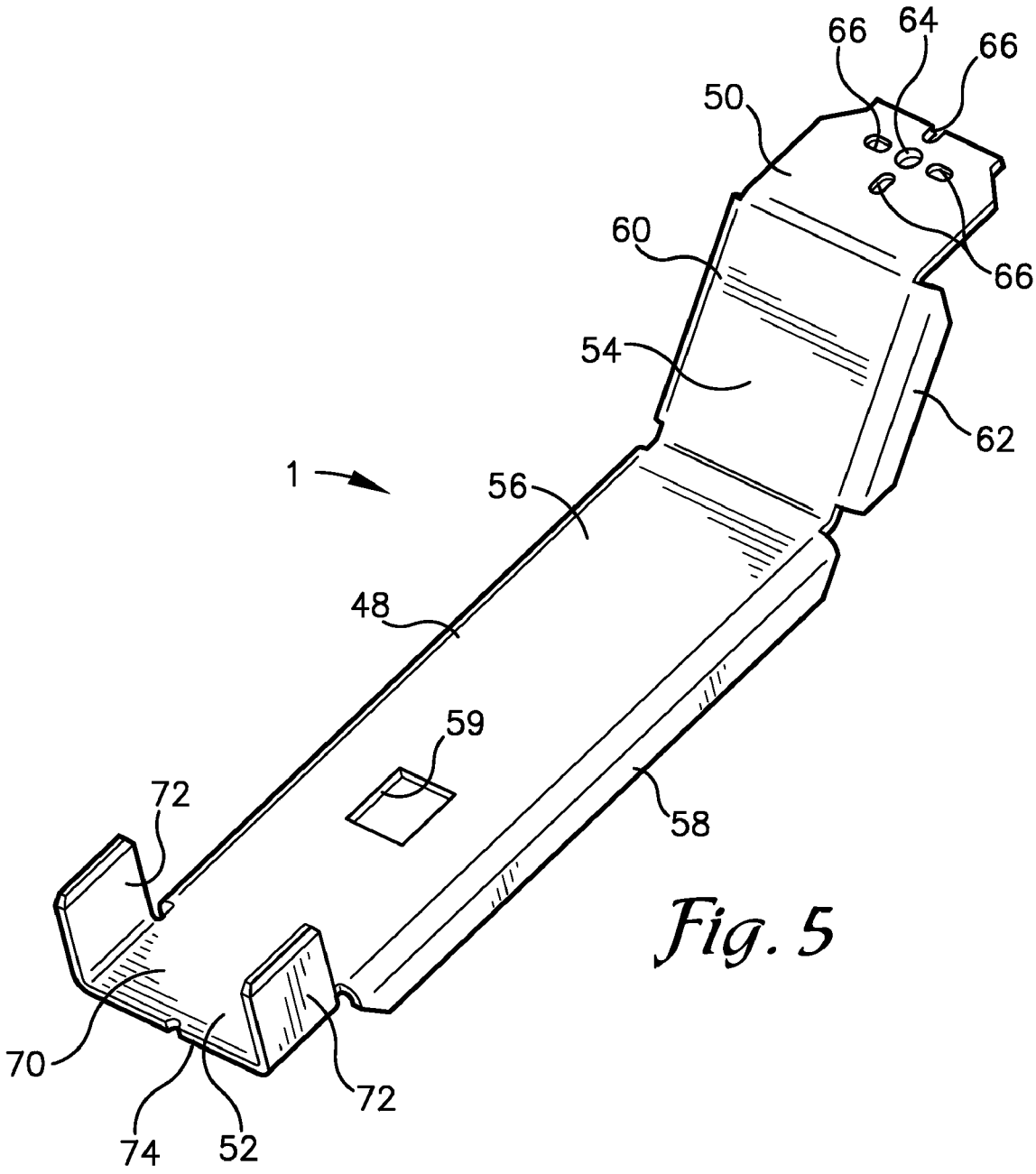
FIG. 5 is a greatly enlarged perspective view of an embodiment of the power meter to circuit breaker connection structure.

In the embodiment illustrated in FIG. 5, each connection structure 1 includes an elongated trunk section 48 with a connection plate 50 at an upper end and a spade section 52 at a lower end. On the illustrated structure 1, the connection plate 50 is joined to the trunk section 48 by a forwardly angled extension section 54. The trunk section 48 includes a trunk web 56 with trunk flanges 58 projecting rearward from lateral edges of the web 56. The trunk section 48 includes a feature to enable it to be secured to the circuit breaker base 32. The illustrated trunk section 48 includes an opening 59, such as a square or rectangular opening, which cooperates with the base 32, as will be detailed below. The illustrated extension section 54 has a construction similar to the trunk section 48 and includes an extension web 60 and extension flanges 62 extending upwardly and rearwardly from lateral edges thereof. The illustrated connection plate 50 is generally planar and includes one or more connection features, such as a fastener receiving aperture 64, and may include additional connection plate orienting features, such as openings 66 formed in a pattern corresponding to orienting features 68 (FIG. 4) formed on the meter jaw bases 10. The angled extension section 54 forwardly offsets the connection plate 50 from the plane of the trunk web 56. The illustrated spade section 52 includes a spade web 70 with a pair of laterally spaced circuit breaker receiving spades or lugs 72 extending forwardly from lateral edges of the web 70. A profile shape of the illustrated connection structure 1 is a stretched Z-shaped structure.

Each of the illustrated connection members 1 is secured to the circuit breaker base 32 by aligning and engaging the trunk web opening 59 with an upper slide-in retainer 40 and a lower edge 74 of the spade section with a lower slide-in retainer 42.

Such alignment also aligns one of the trunk flanges 58 with one of the vertical slots 38 in the circuit breaker base 32. The connection plate 50 of the structure 1 should then be aligned with the load-side end of one of the socket jaw bases 10. The connection plate 50 is secured to the socket jaw base 10, along with a load-side jaw 20 and a blade guide 26 by a screw 76 and nut 78 (FIG. 4). It should be noted that this construction of the illustrated structure 1 is comprised of 13 unique parts and a total of 32 parts. When a left and right had connection structure 1 have been so assembled, an adjacent pair 80 of circuit breaker receiving spades 72 is formed.

The relative positions of meter socket jaws 20 and 26 are prescribed by ANSI C12.7, Requirements for Watt-hour Meter Sockets, to be 2.875 inches (7.3 cm) apart. The relative positions of the circuit breaker mounting spades 80 are prescribed by industry standard at 1.00 inch (2.54 cm) apart. The thickness of the circuit breaker mounting spades 72 are also prescribed by industry standard at 0.093 inches thick. To achieve the 0.093 inch thickness at the circuit breaker mounting spade 72, the entire connection structure 1 is made from a 0.093 inch thick conductive material. Material selection is an important cost consideration. Aluminum, although only 75% as conductive as copper, is ⅙ the cost on an equal cross section basis. To achieve a 200 A capability at 0.093 thick, the invention must be considerably wider than the copper bus bars 202.

The formed trunk side flanges 58 are provided to maintain proper clearances from opposite electrical phases and strengthen the invention in the plane perpendicular to the flanges. The large surface area of the connection structures 1 in comparison to the bus bars 202 employed in the assembly 200 (FIG. 1) and the wired connectors 232 employed in the assembly 230 enhances heat dissipation by convection and radiation, allowing some reduction in cross section of the invention, hence further reducing material cost. The elimination of the connections between the bus bars 202 or wires 232 and their respective circuit breaker receiving elements 211 or 243 reduces electrical resistance, hence further reducing heating of the meter socket assembly 3 employing the connection structures 1. Additionally, the illustrated connection structures 1 can function on either a left hand or right hand side of the socket assembly 3. However, it is foreseen that left and right hand connection structures could be differently configured.

Although the circuit breaker receiving assembly 4 has been shown employing two connection structures 1, it is foreseen that other numbers of structures 1 could be employed, for example, in a multi-phase electrical power service. It is also foreseen that an assembly 4 could be configured such that the circuit breaker receiving spades 72 are positioned in vertically spaced relation instead of horizontal. Additionally, it is foreseen that the connection structures 1 could be configured to provide multiple sets of spaced apart spades 72 to receive multiple plug-in circuit breaker units.

It is to be understood that while certain forms of the present invention have been illustrated and described herein, it is not to be limited to the specific forms or arrangement of parts described and shown.

What is claimed and desired to be secured by Letters Patent is:

1. A one-piece conductive element for connection between a meter socket base and at least one receptacle of a plug-in circuit breaker, said conductive element comprising:

(a) an elongated conductive member having opposite ends and having a substantially uniform thickness, said thickness being substantially the thickness specified for a connection spade receivable in the receptacle of the plug-in circuit breaker;

(b) a socket connection feature at a first end of said conductive member to enable electrical connection of said connection member to a meter socket jaw of a watt-hour meter socket base; and (c) a circuit breaker connection spade formed at a second end of said conductive member, said connection spade being configured to enable reception in the receptacle of the plug-in circuit breaker.

2. A conductive element as set forth in claim 1 wherein:

(a) said socket connection feature is formed in a connection plate positioned at a top end of said conductive member.

3. A conductive element as set forth in claim 2 and including:

(a) an angled extension section extending between said connection plate and said conductive member; and (b) said extension section including a planar extension web having extension flanges formed at opposite lateral edges thereof.

4. A conductive element as set forth in claim 1 wherein:

(a) said conductive member includes an elongated trunk section; and (b) said trunk section includes a planar trunk web having trunk flanges formed along opposite lateral edges thereof.

5. A conductive element as set forth in claim 4 wherein:

(a) said trunk web has a mounting opening formed therethrough to enable mounting said conductive member to a support structure.

6. A conductive element as set forth in claim 1 wherein:

(a) said conductive member includes a spade section, said spade section including a planar spade web having opposite side edges; and (b) said spade web includes a respective circuit breaker connection spade extending frontward from each of said opposite lateral edges.

7. A one-piece conductive element for connection between a watt-hour meter socket base and at least one receptacle of a plug-in circuit breaker, said conductive element comprising:

(a) an elongated conductive member having opposite ends and having a substantially uniform thickness, said thickness being substantially the thickness specified for a connection spade receivable in the receptacle of the plug-in circuit breaker;

(b) said conductive member including a connection plate at a top end thereof, said connection plate having a fastener receiving aperture formed therethrough;

(c) a spade section at a lower end of said conductive member, said spade section having a circuit breaker connection spade extending frontward therefrom to enable reception in the receptacle of the plug-in circuit breaker; and (d) said conductive member including a trunk section extending between said connection plate and said spade section, said trunk section including a mounting opening formed therethrough to enable mounting said conductive member to a support structure.

8. A conductive element as set forth in claim 7 and including:

(a) an angled extension section extending between said trunk section and said connection plate, said extension section positioning said connection plate in a connection plate plane spaced frontward from a trunk plane of said trunk section.

9. A conductive element as set forth in claim 8 wherein:

(a) said extension section includes a planar extension web having extension flanges formed at opposite lateral edges thereof.

10. A conductive element as set forth in claim 7 wherein:

(a) said trunk section includes a planar trunk web having trunk flanges formed at opposite lateral edges thereof.

11. A conductive element as set forth in claim 7 and including:

(a) said spade section including a planar spade web having opposite lateral edges; and (b) said spade web having a respective circuit breaker connection spade extending frontward from each of said opposite lateral edges.

12. A one-piece conductive element for connection between a watt-hour meter socket base and at least one receptacle of a plug-in circuit breaker, said conductive element comprising:

(a) an elongated conductive member having opposite ends and having a substantially uniform thickness, said thickness being substantially the thickness specified for a connection spade receivable in the receptacle of the plug-in circuit breaker;

(b) said conductive member including a connection plate at a top end thereof, said connection plate having a fastener receiving aperture formed therethrough;

(c) a spade section at a lower end of said conductive member, said spade section having a circuit breaker connection spade extending frontward therefrom to enable reception in the receptacle of the plug-in circuit breaker;

(d) said spade section including a planar spade web having opposite lateral edges;

(e) said spade web having a respective circuit breaker connection spade extending frontward from each of said opposite lateral spade section edges thereof;

(f) said conductive member including a trunk section extending between said connection plate and said spade section, said trunk section including a mounting opening formed therethrough to enable mounting said conductive member to a support structure;

(g) said trunk section including a planar trunk web having trunk flanges formed at opposite lateral trunk edges thereof and extending backward from said trunk web;

(h) an angled extension section extending between said trunk section and said connection plate, said extension section positioning said connection plate in a connection plate plane spaced frontward from a trunk plane of said trunk section; and (i) said extension section including a planar extender web having extension flanges formed at opposite lateral extension edges thereof and extending generally backward and upward therefrom.

13. A conductive element as set forth in claim 12 wherein said conductive element is a first conductive element and including:

(a) as second conductive element substantially similar to said first conductive element; and (b) said first and second conductive elements being positioned in laterally spaced relation whereby a first circuit breaker connection spade of said first conductive element is spaced from a second circuit breaker connection spade of said second conductive element and aligned therewith to thereby receive a plug-in circuit breaker thereon.

14. A circuit breaker receiving structure for use in combination with a watt-hour meter socket base to receive a plug-in circuit breaker, said meter socket base including meter socket connector members, and said structure comprising:

(a) an insulating circuit breaker base for mounting in spaced relation to said watt-hour meter socket base;

(b) a first conductive element and a second conductive element secured in laterally spaced relation to said circuit breaker base and electrically connected respectively to said meter socket connector members, each conductive element including:

(1) an elongated conductive member having opposite ends and having a substantially uniform thickness, said thickness being substantially the thickness specified for a connection spade receivable in the receptacle of the plug-in circuit breaker;

(2) said conductive member including a connection plate at a top end thereof, said connection plate having a fastener receiving aperture formed therethrough;

(3) a spade section at a lower end of said conductive member, said spade section having a circuit breaker connection spade extending frontward therefrom to enable reception in the receptacle of the plug-in circuit breaker; and (4) said conductive member including a trunk section extending between said connection plate and said spade section, said trunk section including a mounting opening formed therethrough to enable mounting said conductive member to a support structure; and (c) said first and second conductive elements being positioned in laterally spaced relation whereby a first circuit breaker connection spade of said first conductive element is spaced from a second circuit breaker connection spade of said second conductive element and aligned therewith to thereby receive a plug-in circuit breaker thereon.

15. A structure as set forth in claim 14 wherein each conductive element includes:

(a) an angled extension section extending between said trunk section and said connection plate, said extension section positioning said connection plate in a connection plate plane spaced frontward from a trunk plane of said trunk section.

16. A structure as set forth in claim 15 wherein:

(a) said extension section includes a planar extension web having extension flanges formed at opposite lateral edges thereof.

17. A structure as set forth in claim 14 wherein:

(a) each trunk section includes a planar trunk web having trunk flanges formed at opposite lateral edges thereof.

18. A structure as set forth in claim 14 wherein:

(a) each spade section includes a planar spade web having opposite lateral edges; and (b) said spade web includes a respective circuit breaker connection spade extending frontward from each of said opposite lateral edges.

* * * * *